United States Patent [19]

Pike

[11] 4,364,326

[45] Dec. 21, 1982

[54] DEVICES TO CONTROL BOATS AND OTHER OBJECTS ON MOVING SHIPS

[76] Inventor: Roderick D. Pike, 8 Lower St., Stroud GL5 2HT, Gloucestershire, England

[21] Appl. No.: 172,867

[22] Filed: Jul. 28, 1980

[30] Foreign Application Priority Data

Aug. 29, 1979 [GB] United Kingdom ..... 7929873
Nov. 27, 1979 [GB] United Kingdom ..... 7940881

[51] Int. Cl.[3] ..... B63B 23/02

[52] U.S. Cl. ..... 114/369; 114/372; 114/373; 114/366

[58] Field of Search ..... 114/51, 44, 268, 365–380

[56] References Cited

U.S. PATENT DOCUMENTS 1,024,507 4/1912 Graham ..... 9/40
2,294,864 9/1942 Palmer ..... 9/30
3,137,013 6/1964 Devonport ..... 9/35
3,143,991 8/1964 Anderson ..... 9/34
3,442,241 5/1969 Daunis ..... 114/230

FOREIGN PATENT DOCUMENTS 1327552 4/1963 France ..... 9/38
92844 11/1958 Norway ..... 9/30

*Primary Examiner*—Charles E. Frankfort
*Assistant Examiner*—Stephen P. Avila
*Attorney, Agent, or Firm*—Llewellyn A. Proctor

[57] ABSTRACT

This invention relates to devices and methods to control the movement of boats and other objects, for example container loads, which are being moved above the deck of a ship moving in a seaway. In particular it is concerned with devices to restrain a boat or other object with respect to lateral swinging movement when suspended by a ship-mounted hoist. The invention is of particular, but by no means exclusive, application to the launch and recovery of inflatable and rigid inflatable rescue, life and work boats.

5 Claims, 3 Drawing Figures

DEVICES TO CONTROL BOATS AND OTHER OBJECTS ON MOVING SHIPS

This invention relates to devices and methods to control the movement of boats and other objects, for example container loads, which are being moved above the deck of a ship moving in a seaway. In particular, it is concerned with devices to restrain a boat or other object in respect of lateral swinging movement when suspended by a ship-mounted hoist. The invention is of particular, but by no means exclusive, application to the launch and recovery of inflatable and rigid inflatable rescue, life and work boats.

Current practice when moving boats or other loads using a hoist is to restrain them manually against undesired swinging movement, by the use of ropes or other securing devices with a consequent increase in the manpower required. The invention has the object of obviating this manpower requirement, and to provide devices which can be designed to automate the operation to a large degree, thus making the launch of a boat, for example, both safer and more expedient.

In its simplest aspect the invention provides a device comprising hook-like restraining means which are rigid and fixed relatively to a hoist while being so shaped and disposed as to hook over, and thus restrain, the boat or other object as the latter is lifted from its stowage on the deck of the ship by the hoist. By hauling on the hoist against the hook-like restraining means, the boat (or other object) is held securely against movement induced by the motion of the ship until it is required to be lowered.

According to a somewhat broader aspect, the invention comprises a device to restrain a boat or other object in respect of lateral swinging movement when suspended by a ship-mounted hoist while the ship is moving in a seaway, comprising rigid restraining structure located relatively to the hoist and presenting laterally opposed locating surface portions which are formed to engage the boat or other object and which are so positioned as to provide horizontal location for the engaged boat or other object at least in a direction towards and away from the hoist when the boat or other object is raised from a deck of the ship and suspended by the hoist.

Said laterally opposed surface portions are preferably provided internally of a generally hook-like formation of the restraining structure, which formation is arranged for hook on engagement with a side edge formation of the boat or other object. For example engagement with the gunwale of a rigid boat or the inflatable tube of an inflatable or rigid inflatable boat. A locking device may operate automatically on engagement of the boat (or other object) with the hook-like formation, and this may incorporate manual release means.

The invention will be principally described hereinafter with reference to the restraint of boats, and where appropriate such references are to be read as applying also to the restraint of other loads. Used with boats the invention is especially applicable to a single hoist which can rotate radially about a vertical rotational axis, such as a davit or crane, but it can also be applied to a double hoist. The restraining structure, with a single hoist, will be attached to the rotating section of the crane or davit, normally either to the vertical post or jib, or both. As applied to a luffing davit or crane, the restraining structure should be automatically self-adjusting to restrain the boat so that it remains substantially horizontal as the davit or crane pivots.

The hook-like formation of the restraining structure may present a single inverted hook or a spaced series of hooks the position of which relative to the hoist (particularly as regards level) may be fixed, or adjustable to meet the requirements of different loads or conditions. When adjustable the adjustment may be manual, or under hydraulic or pneumatic power for example. The hook or hooks preferably are designed to engage with the boat as it is being lifted, thus preventing further lifting of the engaged side of the boat if the hoisting lift continues. In this case the boat will tilt slightly under the continued lift and thus be firmly secured against movement at two points, namely the hoist and the hook-engaged edge. A cut-out may be incorporated into the hoist so that the lift stops automatically after the boat or other object has engaged with the restraining structure to the required degree.

Two embodiments of the invention, respectively as applied to a fixed-jib rotating crane and to a luffing davit for the launch and recovery of a boat, are illustrated in a diagrammatic manner in the accompanying drawings and will now be described by way of example.

Figure 2:
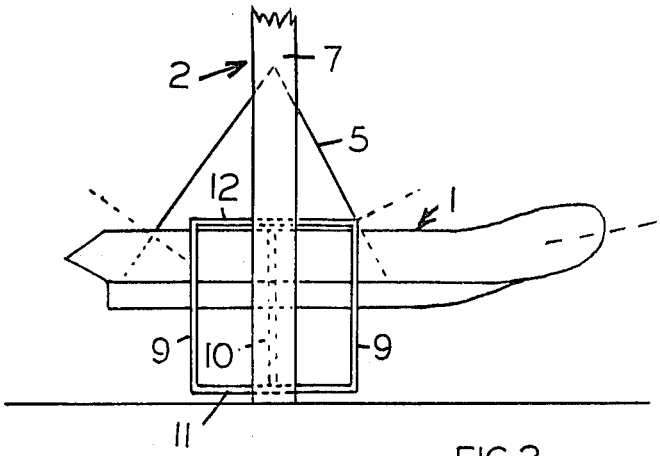
FIG. 2 is a partial corresponding side view.

Each of the illustrated embodiments shows the invention as applied to the restraint of a load in the form of a rigid inflatable boat 1, against lateral swinging movement when lifted by a hoist 2 above the deck 3 of a ship. Reference will first be made to the embodiment of FIGS. 1 and 2, in which the hoist 2 by which the boat 1 is launched and recovered is a fixed jib rotating crane.

The boat 1 is suspended from the jib 4 of the crane 2 by means of a four-legged bridle 5 engaged by the crane hook 6. The crane 2 has a rotating vertical section 7 from the top of which the jib 4 projects and which incorporates a base **7*a* which turns about a vertical rotational axis. A rigid restraining structure 8 is in the form of an open framework comprising three upright members, which are in vertical parallel planes and of the same general side profile, namely two side members 9 and a central member 10. These members 9 and 10 are rigidly interconnected by horizontal members 11 and 12, the lower 11 of which is fixed directly to the base 7*a* and the upper 12 of which is braced to the crane section 7 at an upper level of the latter by rods 13**.

Figure 1:
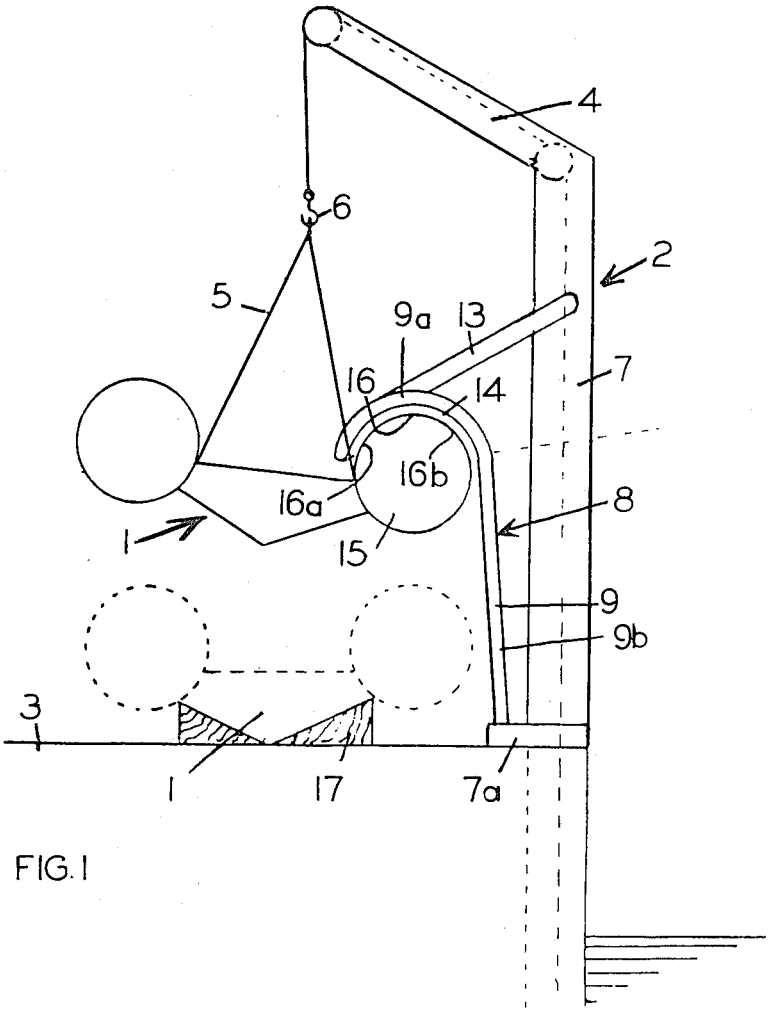
FIG. 1 is a fore-and-aft view of one of the embodiments showing the boat in a lifted position.

In said side profile, as seen in the view of FIG. 1, the frame members 9 and 10 are of inverted hook shape with upper end portions such as **9*a* of generally part-circular shape. These end portions of the steel members 9 and 10 incorporate padding to reduce the possibility of damaging the inflatable tube 15 of the boat 1 as they hook over this tube 15. The internal surface 16 of the hook shape is generally complementary to the cross-sectional profile of the tube 15 and thus the opposite sides of the hook provide laterally opposed locating surface portions 16*a* and 16*b* for locating engagement with the tube 15** as will now be described.

In operation the boat 1 is hoisted from its stowage 17 on the deck 3, the adjacent side of the boat 1 contacting the straight and inwardly inclined portions such as **9*b* of the frame members 9 and 10. These portions are angled slightly to provide the inward inclination which guides and helps to align the boat tube 15 and feed it into the inverted hook portions. After the boat 1 is located under the curved hook portions such as 9***a* of the members 9 and 10, which respectively engage the boat 1 at horizontally spaced regions at each of which opposed surface portions such as 16*a* and 16*b* are operative, hoisting continues until the boat tilts slightly towards the engaged hook portions. In this position, shown in full lines in FIG. 1, the boat is firmly held between the hook portions such as 9*a* and the hoist 2 so that it is restrained against swinging movement which would otherwise be induced by any movement of the crane 2 resulting from the latter being rigidly attached to the ship structure.

With the boat 1 securely restrained in this manner the hoist 2, with the boat 1 attached, can be swung through 180° so that the boat 1 is suspended over the side of the ship. In this position the boat 1 can safely be lowered into the water. A reverse procedure is adopted for recovery of the boat 1, the movement of the boat occasioned by the movement of the ship in a seaway being controlled throughout the critical parts of the recovery operation, i.e. the parts when the moving boat 1 could, if not constrained in accordance with the invention, be damaged by coming into contact with fixed parts of the ship.

Figure 3:
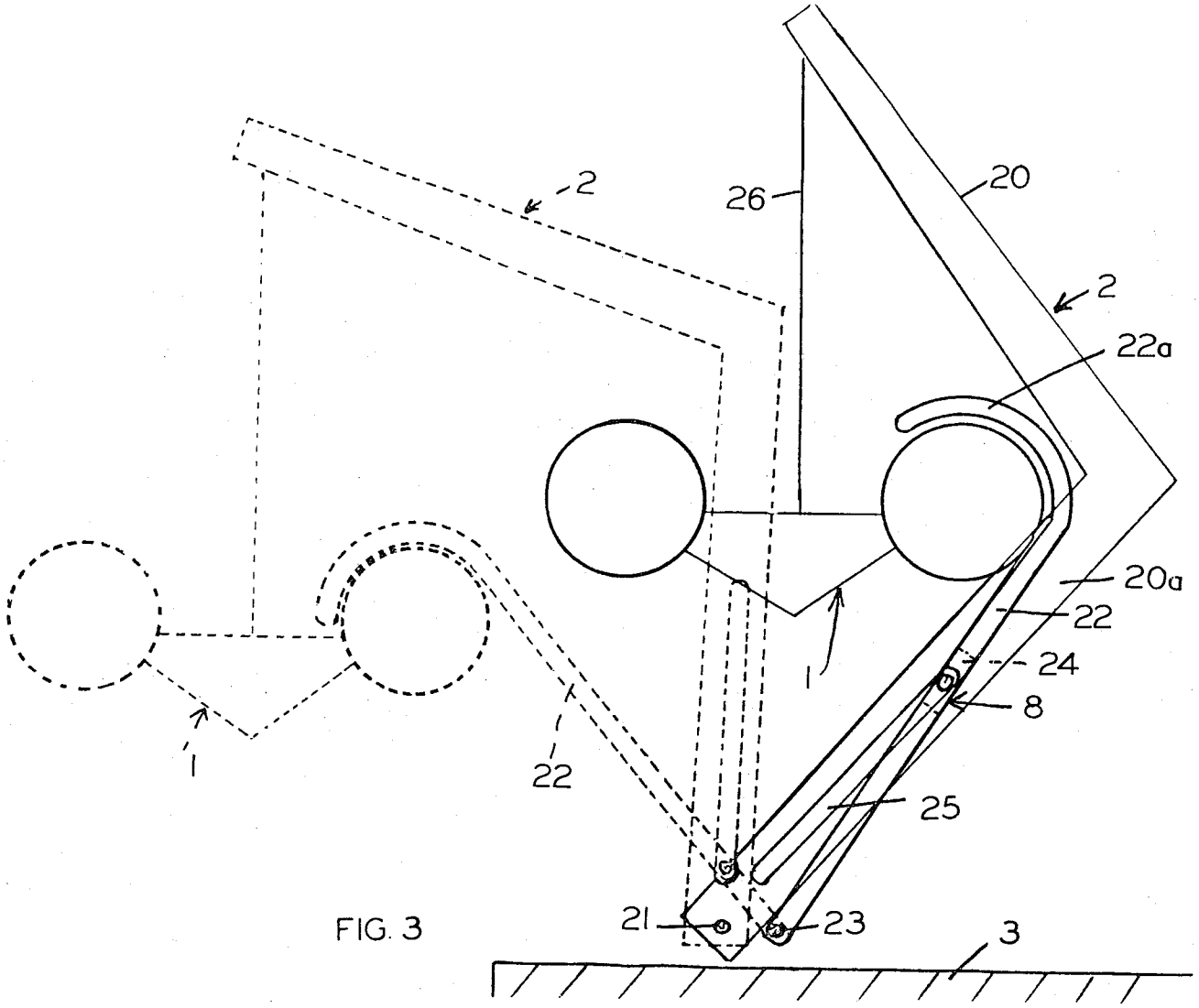
FIG. 3 is a view similar to that of FIG. 1 but of the other embodiment.

In the embodiment of the invention illustrated diagrammatically in FIG. 3, the hoist 2 is a luffing davit which in this case comprises a single davit arm 20 of generally conventional form. A deck mounting (not shown) provides a horizontal fore-and-aft pivot 21 defining a pivotal axis about which the arm 20 moves from the inboard stowed position shown in full lines to an outboard position (shown in broken lines) projecting over the side of the ship. The restraining structure 8 of the invention comprises a pivotal arm 22 with a lower end pivot 23 disposed adjacent, slightly inboard of and at substantially the same level as the davit arm pivot 21. The arm 22 has an inverted hook-shaped upper end portion 22*a* which functions in the manner described for the first embodiment, presenting laterally opposed locating surface portions.

However, in this case instead of the structure 8 being fixed relative to the hoist 2 the arm 22 undergoes pivotal movement dependent on the pivotal position of the davit arm 20. This movement is governed by a crosshead connection 24 which is slidable along the restraining arm and also along a guide, provided by a linear guide slot 25, at the adjacent side of the lower and inwardly inclined portion 20*a* of the davit arm 20. As the davit arm 20 moves outboard from the stowed portion, in which the boat 1 is held slightly tilted against the restraining structure as when lifted from its stowage 17 in FIG. 1, the restraining arm 22 also moves outboard to maintain a close relationship with the boat 1 so that any unplanned movement of the latter is prevented. The result is that the boat 1 remains generally horizontal as it is swung out over the side of the ship, in the outboard position the boat 1 still being secured in the hook portion 22*a* by the upward pull of the hoist wire 26 against the hooked engagement through the boat 1.

To lower the boat 1 the wire 26 is merely slacked away, and on recovery it is hoisted until the boat 1 engages in the hook portion 22*a*. Although a single arm 22 could be employed it will more normally, and far preferably, be one of two similar parallel arms of a double-arm structure with the two retraining arms respectively disposed on opposite sides of the davit arm 20. This prevents the boat from swinging around a vertical axis about the suspending wire 26. A boarding ladder may be incorporated in the arm 22 to give access to the boat 1, when in the outboard position, from the deck 3 of the ship.

In each embodiment the inverted hook portion of the restraining structure 8 may automatically lock in engaged position with the boat 1, and lock release means may be manually operated. Also, a hoist cut-out can readily be incorporated set to provide the requisite hoist lift in which the boat 1 is held securely in engagement with the restraining structure 8.

I claim:

1. In a device characterized as a fixed jib rotating crane, which can be mounted on the deck of a ship, which includes a hoist having a vertical section rotatable about a base, jib projected above said vertical section and base, pulleys and hoist wire, a crane hook attached to the end of said hoist wire from which a bridle can be suspended for attachment to a boat or other object so that the boat or other object can be raised from the deck of the ship, suspended, and lowered, the improvement comprising a rigid restraining structure, in combination with said hoist, located adjacent the vertical section of said hoist, which is constituted of a lower generally straight segment the terminal end of which is attached directly to said base of said hoist, and an upper part-circular shaped section the open, concave side of which presents laterally opposed locating surface portions, the lower straight segment and said concave side of said rigid restraining structure forming a surface against which the boat or other object is rested to avoid physical contact of the boat or other object with said hoist, the concave side of which can engage the side edge portion of the boat or other object to maintain horizontal location for the engaged boat or other object and keep it away from the hoist from which the boat or other object is suspended, the rigid restraining structure rotating in unison with said hoist about the rotational axis thereof to retain its engagement with said boat or other object to thereby suppress the lateral swinging movement of said boat or other object with respect to the hoist as when the ship is moving in a seaway, or the hoist rotated for lowering the boat.

2. A device according to claim 1, wherein the boat carried by the ship has a side inflatable tube, and the concave, part-circular shaped section of the rigid restraining structure is shaped for mating engagement over the inflatable tube.

3. A device according to claim 1 wherein the rigid restraining structure is constituted of an open framework comprised of a plurality of upright members, which are in vertical parallel planes and of the same profile, and interconnected horizontal members.

4. A device according to claim 1, wherein the boat carried by the ship is a rigid boat, and the concave, part-circular shaped section of the rigid restraining structure is shaped for mating engagement over the gunwale of the rigid boat.

5. In a device characterized as a luffing davit which can be mounted on the deck of a ship, the combination which comprises a davit arm having a longitudinally slotted vertical lower portion pivotally attached and rotatable on said deck, an upper portion which is inclined inwardly, a hoist wire and means for the attachment thereof to a boat or other object so that the boat or other object can be raised from the deck of the ship, suspended, and lowered, a rigid restraining arm constituted of a lower generally straight segment the terminal end of which is pivotally attached to said deck and disposed adjacent, slightly inboard of, and substantially at the same level as the attachment of said davit arm, said lower generally straight segment carrying a cross head connection affixed within the longitudinal guide slot at the lower portion of said davit arm, and slidable therein, and an upper part-circular shaped section the open, concave side of which presents laterally opposed locating surface portions which can engage the side edge portion of the boat or other object to provide horizontal location for the engaged boat or other object at least in a direction toward and away from the hoist from which the boat or other object is suspended and thereby suppress the lateral swinging movement thereof with respect to the hoist, and whereupon because of the cross-head connection which is slidable within the longitudinal guide slot at the lower portion of the davit arm provides a linkage which operates automatically to vary the height of engagement with the boat according to the angular position of the hoist, and the boat or other object is held tilted against the restraining structure as when lifted from the deck, the rigid retaining structure moving outwardly to maintain a close relationship with the boat or other object so that any unplanned movement of the latter is prevented.

* * * * *